US008662183B1

(12) United States Patent
Vickio, Jr.

(10) Patent No.: US 8,662,183 B1
(45) Date of Patent: Mar. 4, 2014

(54) BLOW OUT PREVENTER

(76) Inventor: Louis P. Vickio, Jr., Houston, TX (US)

( * ) Notice: Subject to any disclaimer, the term of this patent is extended or adjusted under 35 U.S.C. 154(b) by 277 days.

(21) Appl. No.: 12/931,805

(22) Filed: Feb. 12, 2011

(51) Int. Cl.
*E21B 7/12* (2006.01)

(52) U.S. Cl.
USPC ..... 166/363; 166/364; 166/361; 166/368

(58) Field of Classification Search
USPC ..... 166/363, 364, 361, 368, 382, 373, 386, 166/85.4, 95.1, 316, 332.3, 334.2
See application file for complete search history.

(56) References Cited

U.S. PATENT DOCUMENTS

| | | | | | |
|---|---|---|---|---|---|
| 3,411,576 | A | * | 11/1968 | Taylor, Jr. | 166/363 |
| 3,590,920 | A | * | 7/1971 | Orund et al. | 166/55 |
| 3,766,978 | A | * | 10/1973 | Orund et al. | 166/361 |
| 3,830,306 | A | * | 8/1974 | Brown | 166/53 |
| 3,915,228 | A | * | 10/1975 | Giebeler | 166/321 |
| 4,009,753 | A | * | 3/1977 | McGill et al. | 166/55.1 |
| 4,160,478 | A | * | 7/1979 | Calhoun et al. | 166/55.1 |
| 4,289,165 | A | * | 9/1981 | Fredd | 137/625.32 |
| 4,306,623 | A | * | 12/1981 | Brooks | 166/322 |
| 4,347,900 | A | * | 9/1982 | Barrington | 166/380 |
| 4,576,234 | A | * | 3/1986 | Upchurch | 166/319 |
| 5,284,209 | A | * | 2/1994 | Godfrey | 166/380 |
| 5,551,665 | A | * | 9/1996 | Noack et al. | 251/58 |
| 5,746,249 | A | * | 5/1998 | Wright et al. | 137/614.19 |
| 6,152,229 | A | * | 11/2000 | Jennings | 166/321 |
| 6,244,336 | B1 | * | 6/2001 | Kachich | 166/55 |
| 6,708,946 | B1 | * | 3/2004 | Edwards et al. | 251/58 |
| 7,086,467 | B2 | * | 8/2006 | Schlegelmilch et al. | 166/298 |
| 7,389,817 | B2 | * | 6/2008 | Almdahl et al. | 166/361 |
| 7,849,926 | B2 | * | 12/2010 | Inderberg | 166/363 |
| 2005/0087171 | A1 | * | 4/2005 | Lown | 123/323 |
| 2005/0252660 | A1 | * | 11/2005 | Hughes et al. | 166/334.2 |
| 2010/0051847 | A1 | * | 3/2010 | Mailand et al. | 251/288 |

* cited by examiner

*Primary Examiner* — Matthew Buck
*Assistant Examiner* — Aaron Lembo
(74) *Attorney, Agent, or Firm* — John R. Casperson

(57) ABSTRACT

A blow out preventer comprises a valve casing assembly, a tubing cutter, a hydraulic cylinder and piston, and a linkage assembly. The valve casing assembly has a first port and a second port. The ports are in axial alignment along a longitudinal axis extending between the ports. The well tubing is run through the ports and transversely through the tubing cutter. The tubing cutter is rotatably positioned in the casing assembly and is rotatable from a first position to a second position. The tubing cutter has an axis of rotation which is transverse to the longitudinal axis of the valve casing assembly. The piston is annularly shaped and moves parallel to the longitudinal axis of the valve casing. Linkage between the piston and the tubing cutter converts the axial movement of the piston into rotational movement of the tubing cutter to shear the tubing when needed. When the tubing has been sheared, a seal is formed between a face of the tubing cutter and a valve seat in the valve casing assembly.

15 Claims, 5 Drawing Sheets

BLOW OUT PREVENTER

FIELD OF THE INVENTION

In one aspect, the invention relates to a blow out preventer for use in the drilling of oil and gas wells. In another aspect, the invention relates to a method for preventing or stopping a blowout.

BACKGROUND OF THE INVENTION

Currently there are two types of blow out preventers, a shear blind (cut and seal) and casing shear rams (cut only). Both employ gate valve technology to shear the pipe and close the well. The shear rams are protruded into the well bore from each side, shearing the drill pipe with a scissor style action. To provide the needed forces, large actuators are mounted perpendicularly to the axis of the well bore.

In such systems, the blades have to be kept close together for operability, so that they slide over each other. The forces required to accomplish this when heavy metal objects are being sheared are difficult to achieve. At present, achievable force appears to be less than 1,000,000 lbs.

It has been found that the above configuration and available force are not enough to cut all the configurations of pipe, tube or tools that may be used in the drilling process. What is needed is a configuration that allows enough force to be applied to the cutting mechanism to cut the various configurations of tubular components that may be present. It is an object of this invention to supply such a configuration.

It is a further object of this invention to provide a blow out preventer apparatus which is simpler and more reliable than the configurations which employ actuators perpendicular to the wellbore.

It is another object of this invention to provide a blow out preventer which is capable of providing higher forces than blow out preventers in current use.

SUMMARY OF THE INVENTION

In accordance with one embodiment of the invention, there is provided an apparatus suitable for use as a blow out preventer in the exploration, development, workover, and general well servicing for oil and/or gas wells. The apparatus comprises a valve casing assembly, a tubing cutter, a hydraulic cylinder and piston, and a linkage assembly. The valve casing assembly has a first port and a second port. The ports are in axial alignment along a longitudinal axis extending between the ports. The tubing cutter is rotatably positioned in the casing assembly and is rotatable from a first position to a second position. The tubing cutter has an axis of rotation which is transverse to the longitudinal axis of the valve casing assembly.

The tubing cutter is provided with a transverse passage therethrough which aligns with the first and second end ports of the valve casing assembly when the tubing cutter is in the first position and an exterior surface which seals against a portion of the valve casing assembly when the tubing cutter is in the second position. When the tubing cutter is in the second position, the first end port of the valve casing assembly is isolated from the second end port. In use, the well tubing, well casing, well tools, etc., pass through the transverse passage of the tubing cutter and are susceptible to shearing by the cutter.

The hydraulic piston of the apparatus is positioned in a cylinder which is fixed with respect to the casing assembly. The piston is movable linearly from a first position to a second position.

The linkage assembly connects the hydraulic piston to the tubing cutter and converts the linear movement of the piston to rotational movement of the tubing cutter so that the linear movement of the hydraulic piston from the first position to the second position causes the rotational movement of the tubing cutter from the first position to the second position. The rotational movement is accomplished with sufficient force to shear objects present in the transverse passage of the cutter.

In another embodiment of the invention, there is provided a method for sealing a well. The method is carried out by positioning a blow out preventer on the wellhead. Well tubing is then run into the well through the blow out preventer. In the event blow out conditions are detected in the well bore, the blow out preventer is actuated to shear the tubing and shut in the well.

The blow out preventer for carrying out the method comprises an annular piston positioned concentrically around the tubing, a rotary tubing cutter, a linkage extending between the annular piston and the rotary tubing cutter, and an annular valve seat positioned concentrically around the tubing and adjacent to the rotary tubing cutter. The tubing is sheared by the rotary cutter rotating through an angle of about 90 degrees from a first position to a second position upon urging by the annular piston via the linkage. An outside portion of the rotary cutter contacts the annular valve seat when the rotary cutter is in the second position to seal the inside of the blow out preventer from the outside and contain the well blow out conditions.

DETAILED DESCRIPTION OF THE INVENTION

Figure 1:
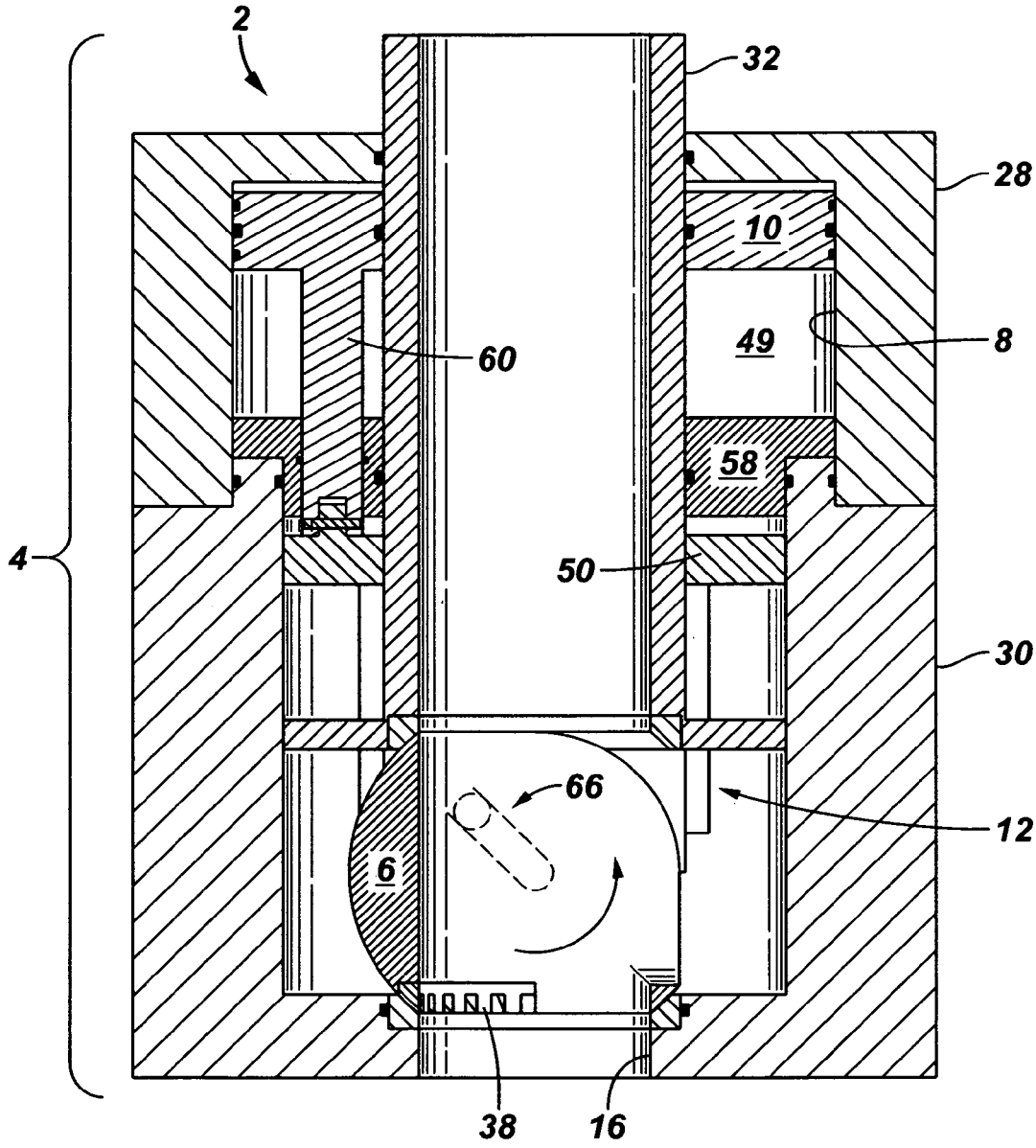
FIG. 1 is a side sectional view of a blowout preventer in accordance with an embodiment of the invention.
Figure 2:
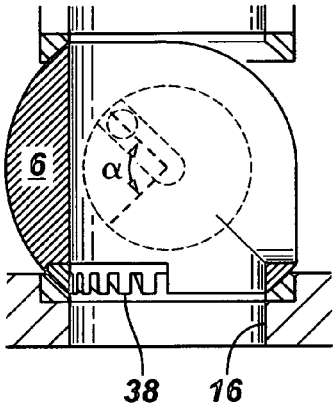
FIG. 2 is a detailed view of a portion of the apparatus of FIG. 1.
Figure 3:
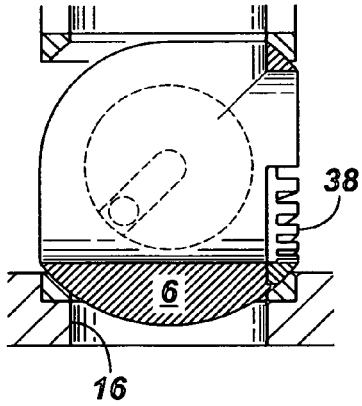
FIG. 3 is a view as in FIG. 2 showing one of the elements in a rotated position.
Figure 4:
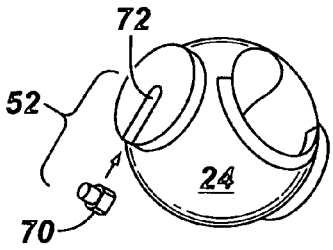
FIG. 4 is a pictorial view of certain elements of the invention in an exploded configuration.
Figure 5:
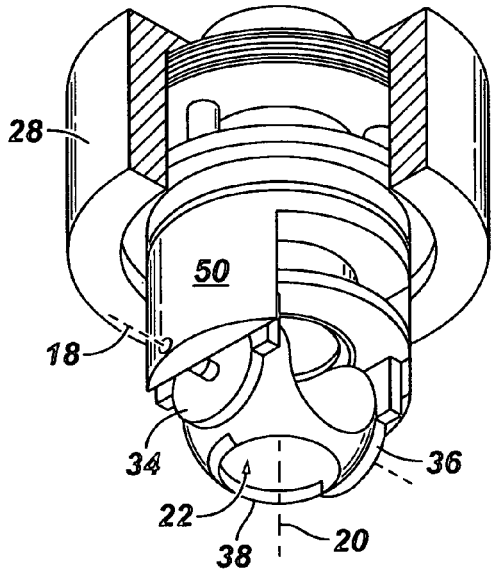
FIG. 5 is a pictorial view of certain elements of the invention in assembled form.
Figure 6:
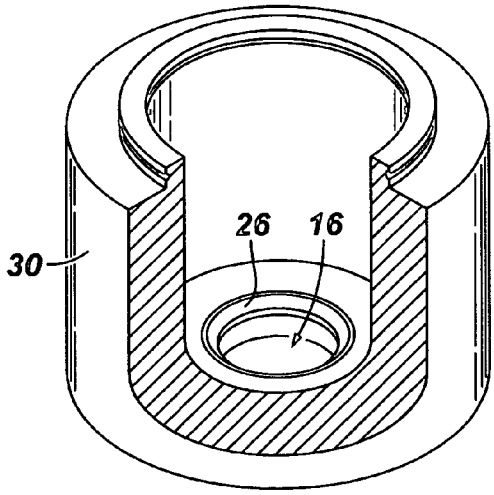
FIG. 6 is a pictorial view of an element of the invention.
Figure 7:
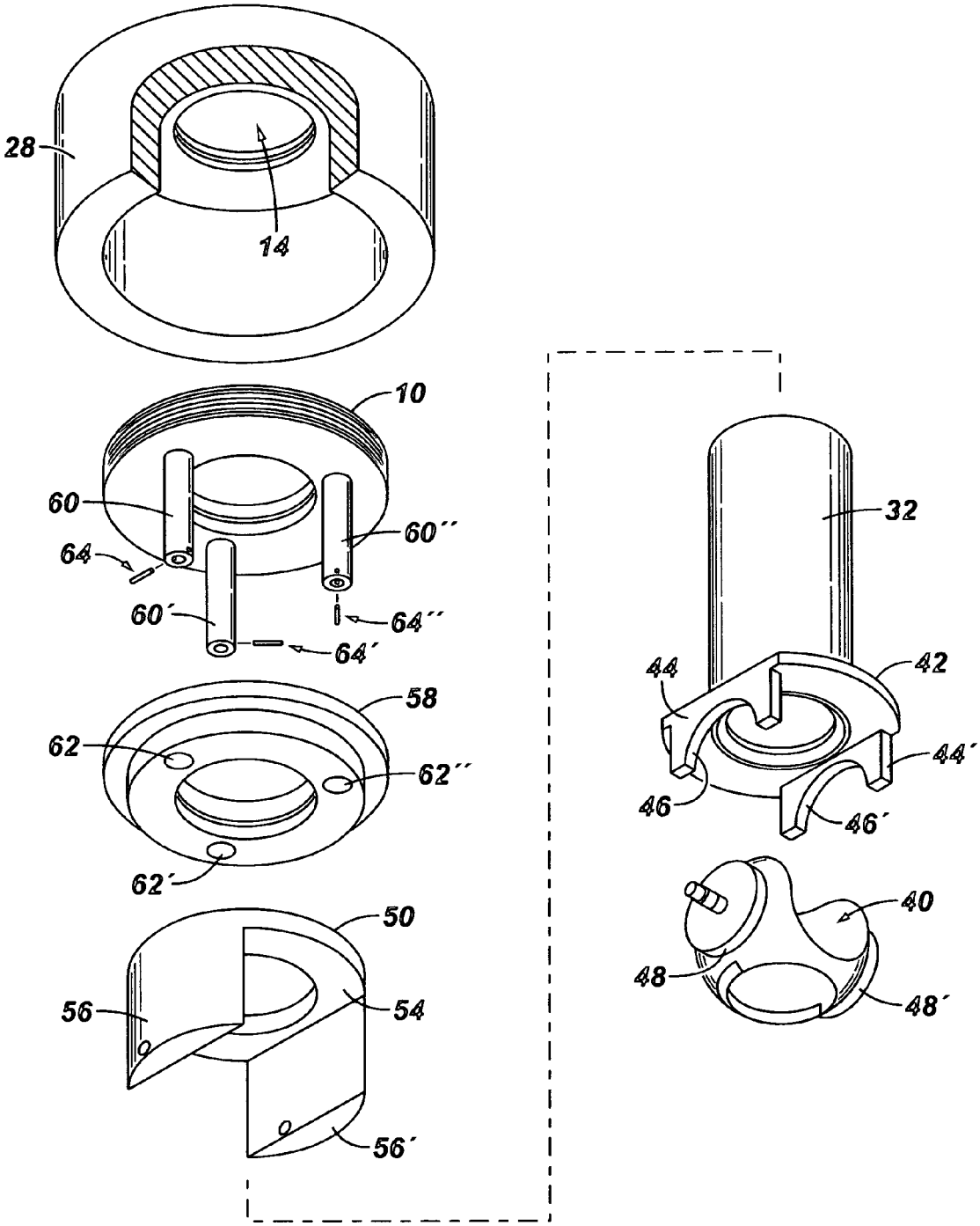
FIG. 7 is an exploded view of the elements of the invention depicted in FIG. 5.

In accordance with an embodiment of the invention as illustrated in FIGS. 1-11, there is provided an apparatus 2 suitable for use as a blow out preventer for a well in the exploration of oil and/or gas. The apparatus comprises a valve casing assembly 4, a tubing cutter 6, a hydraulic cylinder 8 and piston 10, and a linkage assembly 12. The valve casing assembly has a first port 14 (see FIG. 7) and a second port 16 (See FIG. 6). The ports are in axial alignment along a longitudinal axis extending between the ports. The tubing cutter is rotatably positioned in the casing assembly and is rotatable from a first position (See FIG. 2) to a second position (See FIG. 3). The tubing cutter has an axis of rotation 18 which is transverse to the longitudinal axis 20 of the valve casing assembly (See FIG. 5).

The tubing cutter is provided with a transverse passage 22 therethrough. The transverse passage is preferably generally diametrical, with a notch, and aligns with the first and second ports of the valve casing assembly when the tubing cutter is in the first position. An exterior surface 24 of the tubing cutter seals against a portion 26 of the valve casing assembly when the tubing cutter is in the second position. When the tubing cutter is in the second position, the first port of the valve casing assembly is isolated from the second port.

The hydraulic piston of the apparatus is positioned in a cylinder which is fixed with respect to the casing assembly. The piston is movable linearly from a first position (see FIG. 1) to a second position (not shown).

The linkage assembly connects the hydraulic piston to the tubing cutter and converts the linear movement of the piston to rotational movement of the tubing cutter so that the linear movement of the hydraulic piston from the first position to the second position causes the rotational movement of the tubing cutter from the first position to the second position. The rotational movement is accomplished with sufficient force to shear objects present in the transverse passage of the cutter.

Figure 8:
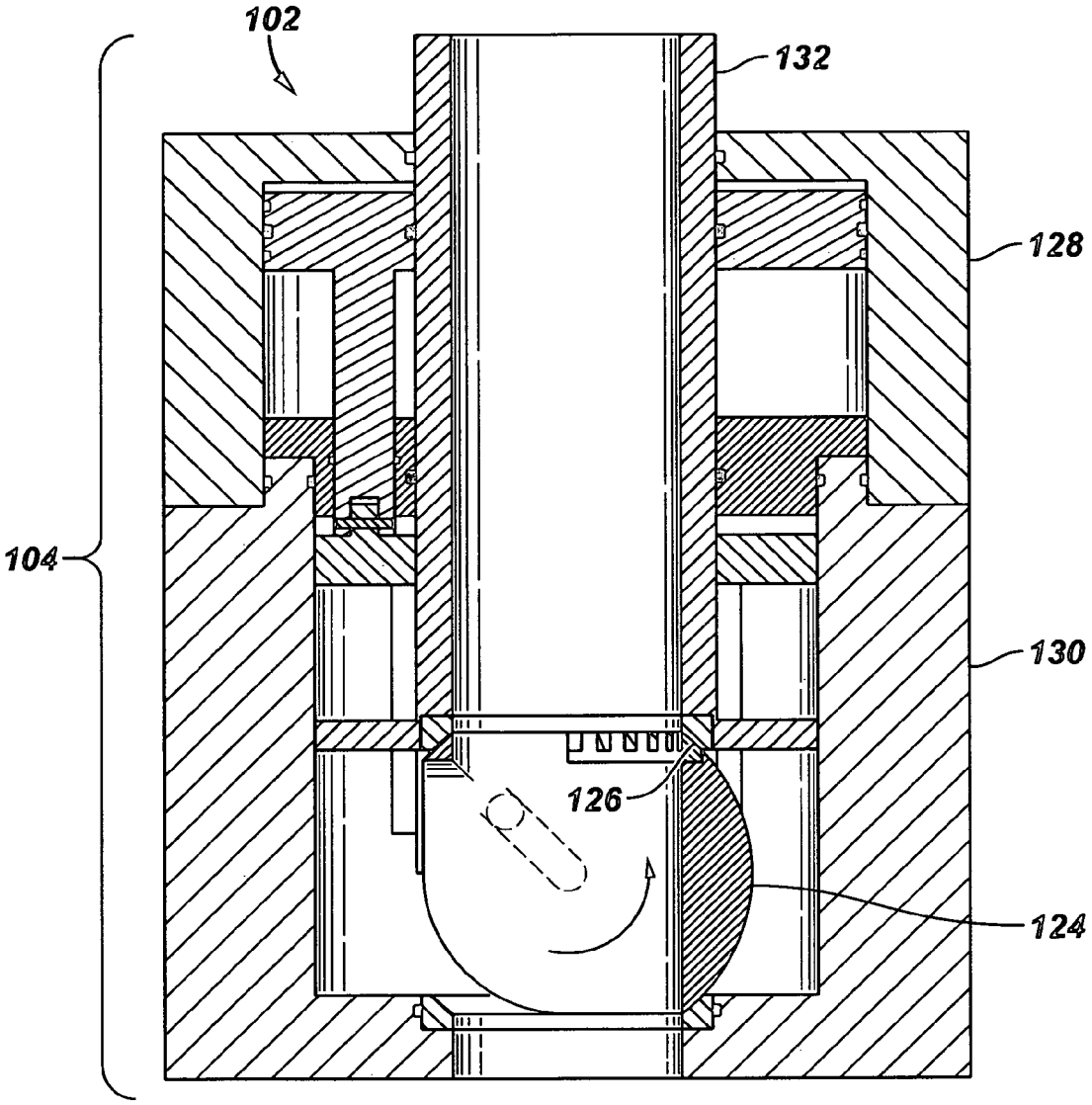
FIG. 8 is a side sectional view of a blowout preventer in accordance with another embodiment of the invention.
Figure 9:
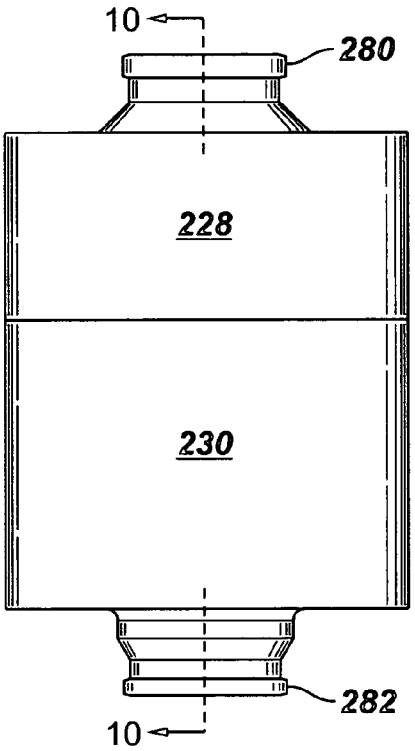
FIG. 9 is a schematic side view of a blowout preventer in accordance with another embodiment of the invention.
Figure 10:
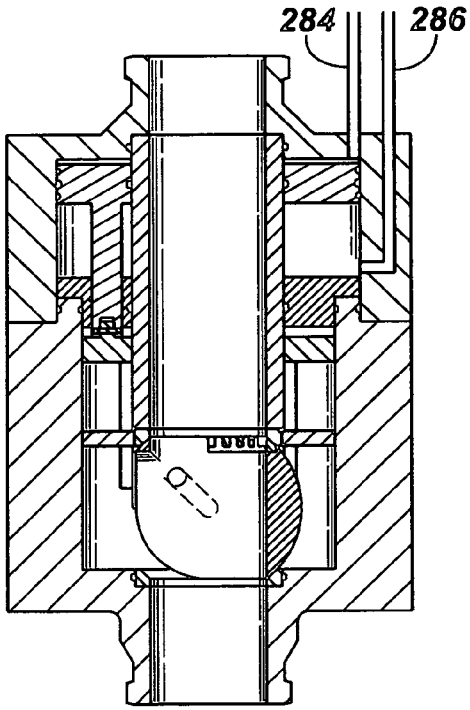
FIG. 10 is a longitudinal sectional view of a blowout preventer as in FIG. 9 taken along lines 10-10.

In the embodiments of the invention illustrated in FIGS. 1 and 8, the valve casing assembly comprises a first valve casing 28, 128 having a first end and a second end and a second valve casing 30, 130 having a first end and a second end. The first end of the second end valve casing 30 is attached to the second end of the first valve casing 28 to form the valve casing assembly having a first port and a second port. The assembly will be installed in line with the well bore and attached to different pieces of equipment depending on the operation performed. For example in subsea or land application the second port will be attached to the wellhead using a customer specified connection. See connector 282 in FIG. 9. The first port will be attached to other customer specified equipment such as a riser, valve(s), or other equipment with a customer specified connection. See connector 280 FIG. 9. Another configuration will have the assembly flipped with the first end connected toward the well head. The assembly is preferably connected to the wellhead so that the sealing surface on the cutter is urged toward a valve seat by well pressure when the BOP has been actuated.

The first valve casing and the second valve casing together define a chamber. A tubular inside casing element 32,132 extends downwardly into the chamber from the first port to provide isolation of the bore and the hydraulic actuator. Without the isolation, the piston would have to further overcome the pressure of the wellbore upon actuation. This same tubular inside casing element holds the seat 126 as well as a bearing surface on the trunnion of the tubular cutter. In the embodiment of the invention shown in FIG. 1, the tubing cutter, in the second position, seals against the portion 26, preferably a valve seat, positioned in the second casing assembly and facing the tubular cutter. The device of FIG. 1 could be flipped if desired to connect to the wellhead at the upper end as shown so that well pressure urges the cutter against its seat after actuation of the cutter. In the embodiment of the invention shown in FIG. 8, the exterior surface 124 of the tubing cutter seals against a second end portion 126, preferably a valve seat, of the tubular inside casing element when the tubing cutter is in the second position.

The tubing cutter comprises a hollow tubing cutter body configured to permit the passage of a straight tubing through the hollow of the tubing cutter body, the hollow defining the transverse passage through the body. The tubing cutter body is rotatably positioned the valve casing assembly. It has a first end 34, (See FIG. 5) and a second end 36 and a longitudinal axis 18 extending between the first end and the second end positioned transversely across the longitudinal axis 20 of the valve casing assembly. At least one sharpened cutting edge surface 38 is positioned for severing a tubing when the tubing cutter body is rotated about its longitudinal axis from a first position to a second position. The hollow of the tubing cutter body is configured to permit such rotation when the tubing is present, such as by providing the body with a relief notch 40 (See FIG. 7) extending in a circumferential direction opposite to the cutter direction of cutting rotation, from the port opposite the port having the cutting edge surface. The notch has a width greater than the diameter of the tubular to slip over the tubular and permit easier rotation of the tubing cutter and provides the passage with an "L" or "boot" shape. When the notch is in line with the well bore, it permits the sheared tubular to be pulled after the cutting operation.

Figure 11:
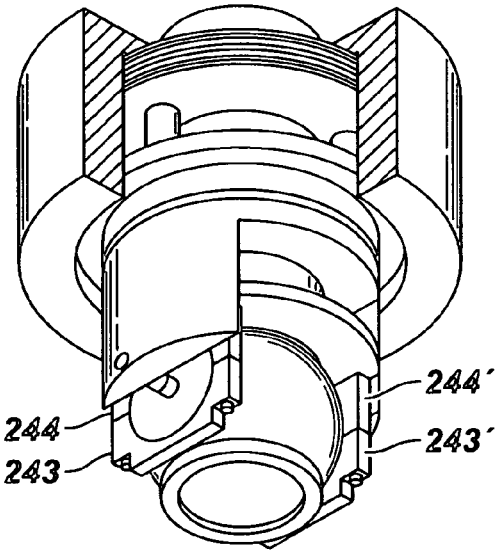
FIG. 11 is a pictorial illustration of some internals of a blowout preventer in accordance with another embodiment of the invention.

In a preferred embodiment of the invention, a yoke 42 is mounted on a second end of the tubular inside casing element. The yoke positions the hollow tubing cutter body for rotation. As best shown in FIG. 1, the tubular inside casing element provides a barrier between the well bore and the hydraulic piston. (Seals are shown in the Figures as blackened rectangles). The yoke comprises a pair of forked carrier arms, the pair of forked carrier arms 44, 44' (See FIG. 7) each defining a semi-cylindrical concave surface 46, 46' for accommodating a pair of cylindrical surfaces 48, 48' (tnumions) near the first end and the second end of the hollow tubing cutter body, one cylindrical surface near each end. In FIG. 11, the yoke arms are identified as 244, 244'. Bearings (not shown) can be present between the tubing cutter body and the yoke if desired if the forks are provided with end caps 243, 243' as shown in FIG. 11. Provision of the end caps and bearings also facilitates rotating the cutter in both directions.

A cylinder chamber 49 is defined between an outside of the tubular inside casing element 32 and an inside cylinder wall 8 of the first valve casing and the hydraulic piston 10 is annularly shaped and fits closely slidably in the cylinder chamber. The linkage assembly preferably comprises a movable actuator 50 and a linkage 52. The actuator has a first end and a second end and is positioned in the second valve casing for longitudinal movement between a first position and a second position. The actuator comprises an annular wall 54 at the first end and a pair of diametrically opposed arms 56, 56' extending normally from the annular wall in a direction away from the piston. The linkage between the actuator and the hollow tubing cutter body is to convert axial movement of the actuator into rotational movement of the hollow tubing cutter body.

In the illustrated embodiment, an annular end cap 58 seals a second end of the cylinder wall and forms the bottom of the piston chamber. The end cap is positioned between the piston and the actuator. The piston divides the piston chamber into a second chamber and a first chamber. A plurality of push rods 60, 60', 60" connect a second end of the piston to the first end of the actuator. The push rods penetrate the end cap through axial boreholes 62, 62', 62" defined by the end cap. Preferably, the rods are fastened to the actuator and to the piston so that the cutter can be rotated back and forth, toward the first or second positions, such as by pins 64, 64', 64" by moving the piston up or down.

In one embodiment of the invention, the linkage comprises a cammming mechanism 66 comprising a cam surface and a cam follower. The cam surface can be on either the actuator or the hollow tubing cutter body. The cam follower rides the cam surface and is connected to the other of the actuator and the hollow tubing cutter body that doesn't define the cam surface.

The cam follower in a preferred embodiment, and as illustrated, comprises a pin 70. The cam surface is defined by a slot 72 in an end face of the hollow tubing cutter body, although the slot could be on an inside face of the actuator. The cam follower is closely received by the slot and is slidably positioned in the slot, so that the hollow tubing cutter body is rotatable in two directions by the cam follower. More preferably, the slot is defined in each end of the hollow tubing cutter body and a pin protrudes from an inside surface of each of the downwardly depending arms of the actuator, each pin being parallel to and spaced apart from the longitudinal axis of the hollow tubing cutter body. See FIG. 7, for example.

The hollow tubing cutter body defines a chamber permitting passage of the tubing therethrough when the tubing cutter body is in the first position. The chamber has a longitudinal axis coinciding with the longitudinal axis of the valve casing assembly. The cutting edge of the tubing cutter body is preferably positioned along a latitudinal line as measured from such longitudinal axis when the hollow tubing cutter body is in the first position. See FIG. 5. The cutting edge is preferably serrated (See FIGS. 2 and 8) and is most preferably positioned adjacent to the second end portion of the tubular inside casing element when the tubing cutter is in the first position (FIG. 8).

For use, the apparatus is connected to an external pressurized supply of hydraulic fluid 284 for closing the cutter and an external pressurized supply of hydraulic fluid 286 for opening the cutter. A single source of pressurized fluid in selectable flow communication with the piston chamber first portion and the piston chamber second portion can be employed if desired. A hydraulic fluid reservoir can be connected in selectable flow communication with the piston chamber first port and the piston chamber second port for collection of exhaust fluid. Selection means can be provided to control the flow of hydraulic fluid in and out of the piston chamber portions, to move the piston up and down and to actuate and retract the cutter, and provision made for redundant means for actuating the piston to achieve near failsafe operation.

The blow out preventer is deployed with the tubing cutter is positioned in the first, retracted position. A well tubing extends through the first and second ports of the valve casing and through the tubing cutter body.

The method of the invention is carried out by positioning a blow out preventer having certain features as described above on a wellhead. Well tubing is then run into the well through the blow out preventer. In the event blow out conditions are detected in the tubing, the blow out preventer is actuated to shear the tubing and contain the well blow out conditions. Drilling fluids can then be pumped into the well through choke and kill lines (not shown) to bring the well under control.

The blow out preventer for carrying out the method preferably comprises an annular piston positioned concentrically around the tubing, a rotary tubing cutter, a linkage extending between the annular piston and the rotary tubing cutter, and an annular valve seat positioned concentrically around the tubing and adjacent to the rotary tubing cutter. The tubing is sheared by the rotary cutter rotating through an angle of about 90 degrees from a first position to a second position upon urging by the annular piston via the linkage. An outside portion of the rotary cutter contacts the annular valve seat when the rotary cutter is in the second position to seal the inside of the blow out preventer from the outside and contain the well blow out conditions. Preferably, the annular piston is moved from a first position to a second position, thereby causing the rotary tubing cutter to rotate from the first position to the second position, and the piston can be moved back and forth if necessary. More preferably, the rotary tubing cutter is cammed into the second position.

In a preferred embodiment of the invention, the hydraulic piston and actuator are both of annular cross section and are positioned on the outside of a tubular device that surrounds the drill pipe and well bore. The size of the piston can be adjusted to meet the pressure closing demands of the cutter. The pressure exerted by the actuator is not reduced by bore pressure.

Actuation is in the axial direction of the drill bore and the use of sizable openings in the blow out preventer casing to actuate the cutters is totally avoided. Actuation can be by fixed controls, which can be remote, or by an ROV. The cutting is performed by a curved cutting blade preferably positioned on a ball or cylindrically shaped cutting body.

While certain preferred embodiments have been described herein, the invention is not to be construed as being so limited, except to the extent that such limitations are found in the claims.

What is claimed is:

1. Apparatus comprising a valve casing assembly having a first port and a second port in axial alignment along a longitudinal axis extending between the ports, a tubing cutter rotatably trunnion-mounted in the valve casing assembly, said tubing cutter having an axis of rotation which is transverse to the longitudinal axis of the valve casing assembly, said tubing cutter being rotatable from a first position to a second position, wherein the tubing cutter has a transverse passage therethrough which aligns with the first and second ports of the valve casing assembly when the tubing cutter is in the first position and an exterior surface which seals against a portion of the valve casing assembly when the tubing cutter is in the second position and isolates the first port of the valve casing assembly from the second port, a hydraulic piston positioned in a cylinder fixed with respect to the casing assembly said piston being movable linearly from a first position to a second position, and a linkage assembly connecting the hydraulic piston to the tubing cutter for converting linear movement of the piston to rotational movement of the tubing cutter so that the linear movement of the hydraulic piston from the first position to the second position causes rotational movement of the tubing cutter from the first position to the second position, wherein the linkage assembly comprises an actuator connected to the hydraulic piston, said actuator having a first end and a second end and positioned in the second valve casing for longitudinal movement between a first position and a second position, said actuator comprising an annular wall at the first end and a pair of diametrically opposed arms depending normally from the annular wall in a direction away from the piston, and a linkage between each of the diametrically opposed arms of the actuator and the hollow tubing cutter body to convert axial movement of the actuator into rotational movement of the hollow tubing cutter body.

2. Apparatus as in claim 1 wherein the valve casing assembly comprises a first valve casing having a first end and a second end, a second valve casing having a first end and a second end, the first end of the second valve casing being attached to the second end of the first valve casing to form the valve casing assembly, wherein the first end of the first valve casing defines the first port, the second end of the second valve casing defines the second port, and the first valve casing and the second valve casing together define a chamber, said valve casing assembly further comprising a tubular inside casing element extending axially into the chamber from the first port, wherein the exterior surface of the tubing cutter seals against a second end portion of the tubular inside casing element when the tubing cutter is in the second position, wherein the linkages each comprises a cam surface defined by one of each arm of the actuator and the hollow tubing cutter body and a cam follower which rides the cam surface and is connected to the other of each arm of the actuator and the hollow tubing cutter body.

3. Apparatus as in claim 2 wherein the tubing cutter comprises a hollow tubing cutter body configured to permit the passage of a straight tubing through the hollow of the tubing cutter body, said tubing cutter body being rotatably positioned in the second valve casing, said tubing cutter body having a first end and a second end and a longitudinal axis extending between the first end and the second end, the longitudinal axis of the tubing cutter body being positioned transversely across the longitudinal axis of the valve casing assembly, said tubing cutter body defining at least one sharpened cutting edge surface positioned for severing a tubing when the tubing cutter body is rotated about its longitudinal axis from a first position to a second position, the hollow of the tubing cutter body being configured to permit such rotation when the tubing is present, wherein each cam follower comprises a pin protruding from an arm of the actuator, and each cam surface is defined by a slot in an end face of the hollow tubing cutter body, each pin being closely received by a slot and being slidably positioned in the slot, so that the hollow tubing cutter body is rotatable in two directions by the pin.

4. Apparatus as in claim 3 further comprising a yoke mounted on a second end of the tubular inside casing element, said yoke positioning the hollow tubing cutter body for rotation, wherein said tubular inside casing element extends from the first port of the first valve casing in sealing relationship therewith, wherein the yoke comprises a pair of forked carrier arms, the pair of forked carrier arms each defining a semi-cylindrical concave surface for accommodating a pair of cylindrical surfaces near the first end and the second end of the hollow tubing cutter body, one cylindrical surface near each end.

5. Apparatus as in claim 4 wherein the cylinder chamber is defined between an outside of the tubular inside casing element and an inside of the first valve casing and the hydraulic piston is of annular cross section and fits closely slidably in the cylinder chamber.

6. Apparatus comprising a valve casing assembly having a first port and a second port in axial alignment along a longitudinal axis extending between the ports, a tubing cutter rotatably positioned in the valve casing assembly, said tubing cutter having an axis of rotation which is transverse to the longitudinal axis of the valve casing assembly, said tubing cutter being rotatable from a first position to a second position, wherein the tubing cutter has a transverse passage therethrough which aligns with the first and second ports of the valve casing assembly when the tubing cutter is in the first position and an exterior surface which seals against a portion of the valve casing assembly when the tubing cutter is in the second position and isolates the first port of the valve casing assembly from the second port, a hydraulic piston positioned in a cylinder fixed with respect to the casing assembly said piston being movable linearly from a first position to a second position, and a linkage assembly connecting the hydraulic piston to the tubing cutter for converting linear movement of the piston to rotational movement of the tubing cutter so that the linear movement of the hydraulic piston from the first position to the second position causes rotational movement of the tubing cutter from the first position to the second position wherein the valve casing assembly comprises a first valve casing having a first end and a second end, a second valve casing having a first end and a second end, the first end of the second valve casing being attached to the second end of the first valve casing to form the valve casing assembly, wherein the first end of the first valve casing defines the first port, the second end of the second valve casing defines the second port, and the first valve casing and the second valve casing together define a chamber, said valve casing assembly further comprising a tubular inside casing element extending axially into the chamber from the first port, wherein the exterior surface of the tubing cutter seals against a second end portion of the tubular inside casing element when the tubing cutter is in the second position;

wherein the tubing cutter comprises a hollow tubing cutter body configured to permit the passage of a straight tubing through the hollow of the tubing cutter body, said tubing cutter body being rotatably positioned in the second valve casing, said tubing cutter body having a first end and a second end and a longitudinal axis extending between the first end and the second end, the longitudinal axis of the tubing cutter body being positioned transversely across the longitudinal axis of the valve casing assembly, said tubing cutter body defining at least one sharpened cutting edge surface positioned for severing a tubing when the tubing cutter body is rotated about its longitudinal axis from a first position to a second position, the hollow of the tubing cutter body being configured to permit such rotation when the tubing is present;

said apparatus further comprising a yoke mounted on a second end of the tubular inside casing element, said yoke positioning the hollow tubing cutter body for rotation, wherein said tubular inside casing element extends from the first port of the first valve casing in sealing relationship therewith, wherein the yoke comprises a pair of forked carrier arms, the pair of forked carrier arms each defining a semi-cylindrical concave surface for accommodating a pair of cylindrical surfaces near the first end and the second end of the hollow tubing cutter body, one cylindrical surface near each end;

wherein the cylinder chamber is defined between an outside of the tubular inside casing element and an inside of the first valve casing and the hydraulic piston is of annular cross section and fits closely slidably in the cylinder chamber;

wherein the linkage assembly comprises an actuator having a first end and a second end positioned in the second valve casing for longitudinal movement between a first position and a second position, said actuator comprising an annular wall at the first end and a pair of diametrically opposed arms extending from the annular wall away from the piston, and a linkage between the actuator and the hollow tubing cutter body to convert axial movement of the actuator into rotational movement of the hollow tubing cutter body;

said apparatus further comprising an annular end cap sealing a second end of the cylinder and forming a piston chamber, the piston dividing the piston chamber into a second chamber and a first chamber, the annular end cap being positioned between the piston and the actuator, and a plurality of push rods connecting a second end of the piston with a first end of the actuator, said push rods penetrating the end cap through axial boreholes defined by the end cap.

7. Apparatus as in claim 6 wherein the linkage comprises a cam surface defined by one of the actuator and the hollow tubing cutter body and a cam follower which rides the cam surface and is connected to the other of the actuator and the hollow tubing cutter body.

8. Apparatus as in claim 7 wherein the cam follower comprises a pin, and the cam surface is defined by a slot in an end face of the hollow tubing cutter body, the pin is closely received by the slot and slidably positioned in the slot, so that the hollow tubing cutter body is rotatable in two directions by the pin.

9. Apparatus as in claim 8 wherein a slot is defined in each end of the hollow tubing cutter body and a pin protrudes from an inside surface of each of the downwardly depending arms of the actuator, each pin being parallel to and spaced apart from the longitudinal axis of the hollow tubing cutter body.

10. Apparatus as in claim 9 wherein the hollow tubing cutter body defines a chamber permitting passage of the tubing therethrough when the tubing cutter body is in the first position, said chamber having a longitudinal axis coinciding with the longitudinal axis of the valve casing assembly, said hollow tubing cutter body defining a cutting edge positioned along a latitudinal line as measured from such longitudinal axis when the hollow tubing cutter body is in the first position.

11. Apparatus as in claim 6 further comprising a pressurized supply of hydraulic fluid in selectable flow communication with the piston chamber first portion.

12. Apparatus as in claim 6 further comprising a well tubing extending through the first and second ports, said well tubing having a longitudinal axis, said tubing extending through the hollow of the tubing cutter body, said tubing cutter body being in the first position.

13. A method for sealing a well, said well having a wellhead, said method comprising positioning a blow out preventer on the wellhead, running tubular into the well through the blow out preventer, detecting well blow out conditions in the tubular, actuating the blow out preventer to shear the tubular, and containing the well blow out conditions in the blow out preventer, wherein the blow out preventer comprises an annular piston positioned concentrically around the tubular, a trunnion-mounted rotary tubing cutter having an opposed pair of end faces and a camming surface formed into each end face, a linkage extending between the annular piston and the rotary tubing cutter, and an annular valve seat positioned concentrically around the tubular and adjacent to the rotary tubing cutter, the tubular is sheared by the rotary cutter rotating through an angle of about 90 degrees from a first position to a second position upon urging by the annular piston via the linkage, and an outside portion of the rotary cutter contacts the annular valve seat when the rotary cutter is in the second position to seal the inside of the blow out preventer from the outside and contain the well blow out conditions in the blow out preventer, said method further comprising camming the rotary tubing cutter into the second position.

14. A method as in claim 13 further comprising moving the annular piston from a first position to a second position, thereby causing the rotary tubing cutter to rotate from the first position to the second position.

15. A method as in claim 13 wherein the tubular is drill pipe.

* * * * *